US008276832B2

(12) United States Patent
Nelson et al.

(10) Patent No.: US 8,276,832 B2
(45) Date of Patent: Oct. 2, 2012

(54) MULTIPLE SPRAY ACTUATOR OVERCAP

(75) Inventors: Cory J. Nelson, Racine, WI (US); Bjorn James Gunderson, Chicago, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 603 days.

(21) Appl. No.: 12/507,173

(22) Filed: Jul. 22, 2009

(65) Prior Publication Data

US 2011/0017781 A1 Jan. 27, 2011

(51) Int. Cl.
*B05B 15/00* (2006.01)

(52) U.S. Cl. ..... 239/391; 239/394; 239/397; 239/442; 239/548; 239/581.1; 222/402.13; 222/402.17

(58) Field of Classification Search ..... 222/402.13, 222/402.17; 239/390–397, 442, 436, 581.1, 239/548, 551

See application file for complete search history.

(56) References Cited

U.S. PATENT DOCUMENTS

| | | | | |
|---|---|---|---|---|
| 3,180,536 | A | 4/1965 | Meshberg | |
| 3,212,680 | A | 10/1965 | Crowell | |
| 3,246,850 | A * | 4/1966 | Bourke | 239/394 |
| 3,386,631 | A | 6/1968 | Kotuby | |
| 3,531,026 | A | 9/1970 | Venus | |
| 3,539,078 | A | 11/1970 | Venus | |
| 3,583,642 | A | 6/1971 | Crowell et al. | |
| 3,703,994 | A * | 11/1972 | Nigro | 239/397 |
| 3,711,030 | A | 1/1973 | Jones | |
| 3,734,353 | A | 5/1973 | McIlhenny | |
| 3,795,366 | A | 3/1974 | McGhie et al. | |
| 3,894,665 | A | 7/1975 | Swenson | |
| 4,068,782 | A | 1/1978 | Van der Heijden | |
| 4,378,081 | A | 3/1983 | van Lit | |
| 4,690,312 | A | 9/1987 | Crapser et al. | |
| 5,027,982 | A | 7/1991 | Demarest | |
| D323,117 | S | 1/1992 | Demarest | |
| 5,105,989 | A | 4/1992 | Gutkowski | |
| 5,385,303 | A * | 1/1995 | Gosselin et al. | 239/394 |
| 5,386,940 | A | 2/1995 | Berfield | |

(Continued)

FOREIGN PATENT DOCUMENTS

DE 102005055979 A1 10/2006

OTHER PUBLICATIONS

PCT/US2010/002089 International Search Report dated Jan. 25, 2011.

*Primary Examiner* — Jason Boeckmann

(57) ABSTRACT

An actuator overcap for producing multiple spray patterns includes a cap having a hub with a lower surface defining a socket and an upper surface defining a chamber fluidly communicating with the socket. First and second barrels extend between the hub and a side wall of the cap to define first and second flow paths. A trigger is pivotably coupled to the cap and includes a seal support. A selector is coupled to the trigger, and includes a user-engageable pad and a seal. The seal is configured to closely fit within the hub chamber and defines a central aperture fluidly communicating with the hub chamber and a first notch extending radially outwardly from and fluidly communicating with the central aperture. The trigger and selector are pivotable with respect to the cap to place the first notch in fluid communication with one of the first and second flow paths.

16 Claims, 8 Drawing Sheets

U.S. PATENT DOCUMENTS

| | | | |
|---|---|---|---|
| D365,990 | S | 1/1996 | McSwiggan et al. |
| 5,649,645 | A | 7/1997 | Demarest et al. |
| D407,018 | S | 3/1999 | Soller et al. |
| D414,416 | S | 9/1999 | Watkins |
| D416,490 | S | 11/1999 | Kunesh |
| 6,006,957 | A | 12/1999 | Kunesh |
| D436,038 | S | 1/2001 | Ruiz de Gopegui |
| 6,318,595 | B1 | 11/2001 | Walters |
| D470,402 | S | 2/2003 | Kunesh et al. |
| D470,752 | S | 2/2003 | Kunesh et al. |
| D481,935 | S | 11/2003 | Kunesh et al. |
| 6,691,937 | B2 | 2/2004 | Heren et al. |
| 6,719,219 | B1 | 4/2004 | Wang |
| D490,710 | S | 6/2004 | Bayer et al. |
| D501,794 | S | 2/2005 | Kunesh et al. |
| 6,868,989 | B2 | 3/2005 | Fahy et al. |
| D510,267 | S | 10/2005 | Miller et al. |
| D529,381 | S | 10/2006 | Castillo Higareda et al. |
| 7,240,857 | B1 | 7/2007 | Stern et al. |
| D557,145 | S | 12/2007 | Miller et al. |
| 2004/0141797 | A1 | 7/2004 | Garabedian et al. |

* cited by examiner

FIG. 1
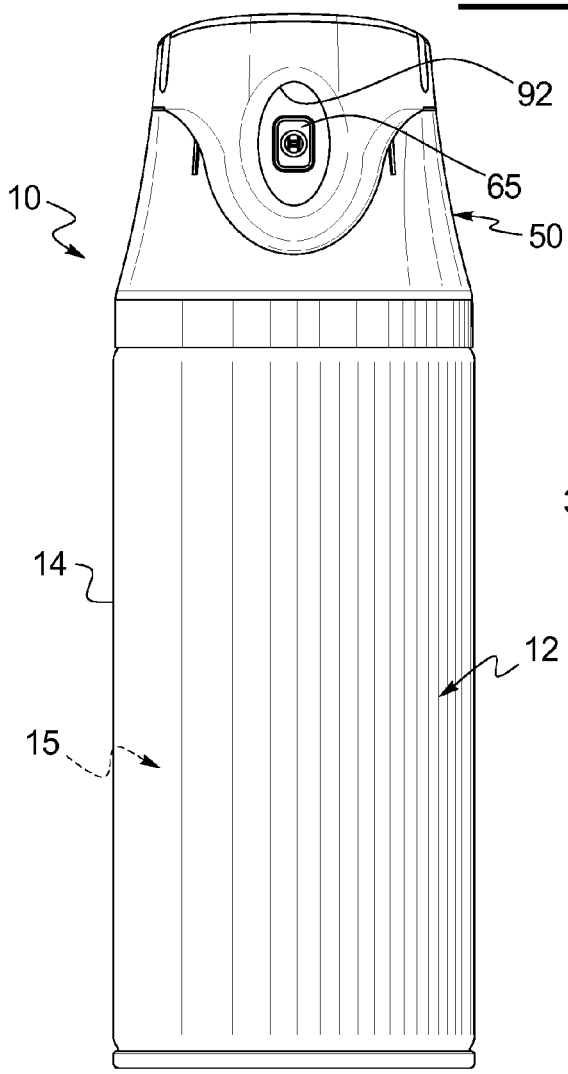
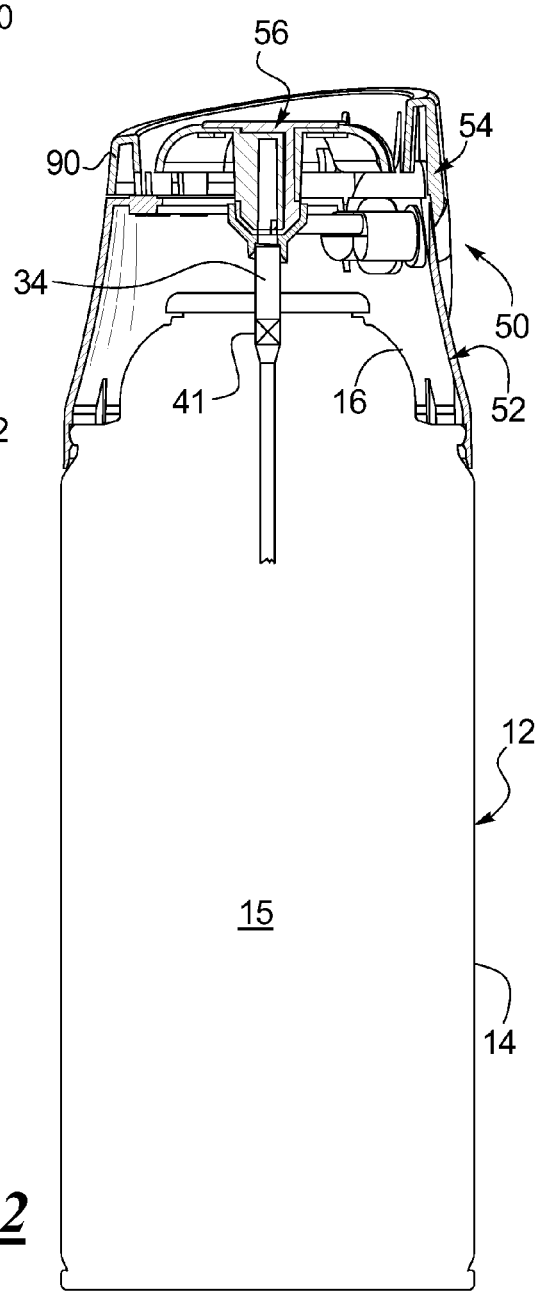
FIG. 2

FIG. 9
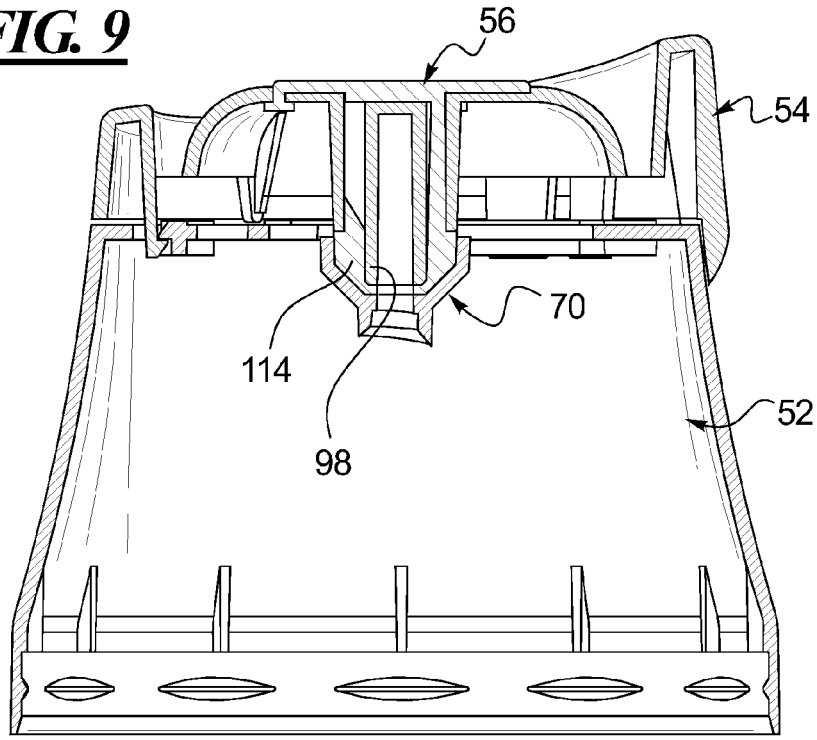
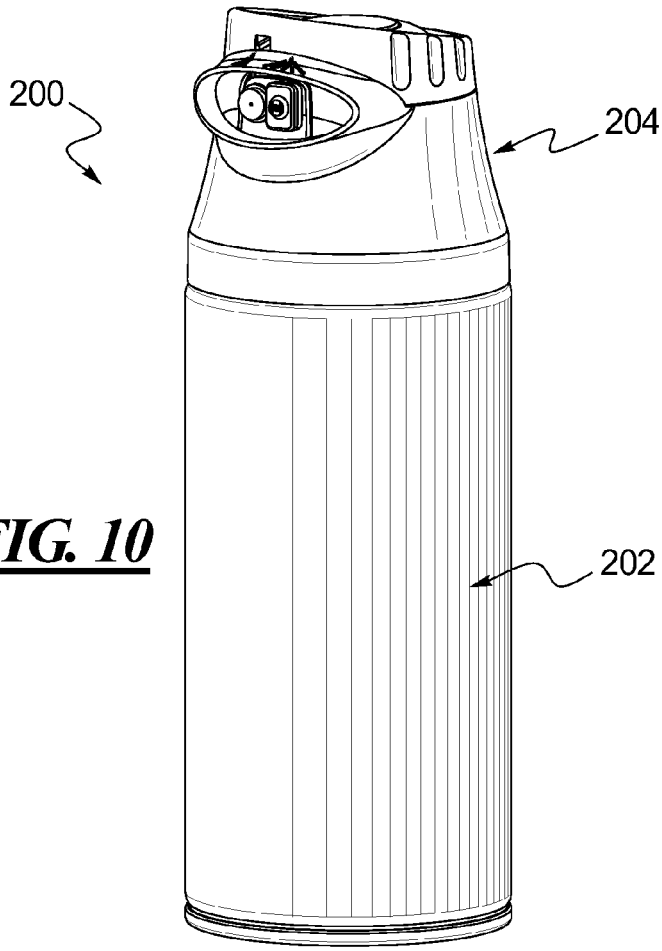
FIG. 10

MULTIPLE SPRAY ACTUATOR OVERCAP

FIELD OF THE DISCLOSURE

The present disclosure generally relates to fluid dispensing devices and, more particularly, to actuator overcaps used with such fluid dispensing devices.

BACKGROUND OF THE DISCLOSURE

Various types of fluid dispensing devices are known for dispensing controlled amounts of fluid in a spray pattern. Many of these devices include an aerosol container having a pressurized supply of fluid therein. A spray head may be connected to an outlet of a stem valve of the container, and may include a spray orifice configured to provide a desired spray pattern.

Some of the known fluid dispensing devices are capable of producing multiple different spray patterns. Certain of these multiple spray devices adjust the spray pattern by changing a spray nozzle located at the spray orifice. Other multi-spray devices use multiple barrels and/or sockets with dedicated spray nozzles to change spray patterns. In general, however, conventional multi-spray devices do not reliably seal between the valve stem and the socket(s). This problem is exacerbated in multiple barrel devices, where the position of the overcap is adjusted to change between spray patterns. Still further, conventional overcaps fail to reliably disengage from the socket after use, which may lead to inadvertent drooling from the nozzle after the overcap is released.

SUMMARY OF THE DISCLOSURE

According to certain embodiments, an actuator overcap defines multiple spray paths and includes a seal for reliably sealing between the spray paths. The overcap may be used with a canister having a stem valve, and may include a cap having a bottom edge configured to engage the canister. The cap may also include a hub having a lower surface and an upper surface, the hub lower surface defining a socket configured to engage the stem valve, the hub upper surface defining a chamber fluidly communicating with the socket. A first barrel may extend between the hub and a side wall of the cap and define a first flow path and a first discharge orifice fluidly communicating with the first flow path, and a second barrel may extend between the hub and the cap side wall and define a second flow path and a second discharge orifice fluidly communicating with the second flow path. A trigger may be pivotably coupled to the cap and have a side wall, a top wall, and a boss extending through the trigger top wall, the boss having a lower edge defining a seal support. A selector may be coupled to the trigger and include a user-engageable pad disposed above the trigger top wall and a seal disposed below the trigger top wall. The seal may be configured to closely fit within the hub chamber, the seal further defining a central aperture fluidly communicating with the hub chamber and have a first notch extending radially outwardly from and fluidly communicating with the central aperture. The trigger and selector may be pivotable with respect to the cap to place the first notch in fluid communication with one of the first and second flow paths.

BRIEF DESCRIPTION OF THE DRAWINGS

For a more complete understanding of this disclosure, reference should be made to the embodiments illustrated in greater detail on the accompanying drawings, wherein:

FIG. 1 is a side elevation view of a fluid dispensing device having an actuator overcap constructed in accordance with the present disclosure;

FIG. 2 is a side elevation view, in cross-section, of the fluid dispensing device of FIG. 1;

FIG. 9 is a side elevation view, in cross-section, of the actuator overcap of FIG. 3;

FIG. 10 is a perspective view of a fluid dispensing device including a second embodiment of an actuator overcap constructed in accordance with the present disclosure;

Figure 3:
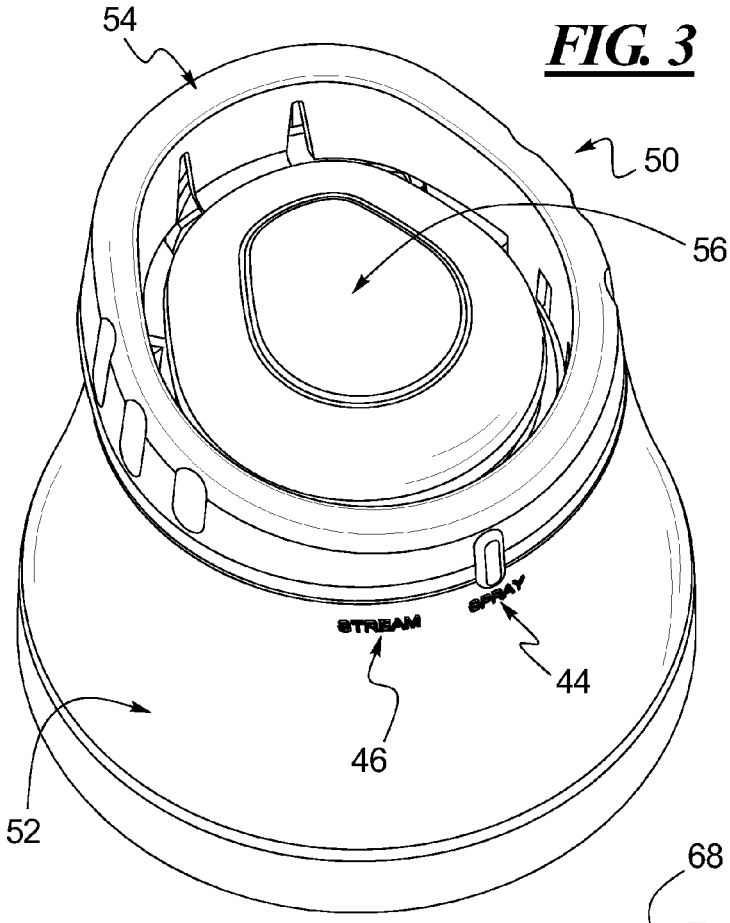
FIG. 3 is an enlarged, rear perspective view of the actuator overcap provided with the fluid dispensing device of FIG. 1.

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF THE DISCLOSURE

Various embodiments of a dispensing device are disclosed herein that are capable of producing at least two different spray patterns. The dispensing device may include an adjustable actuator overcap having multiple spray nozzles, wherein each spray nozzle has an associated barrel defining a product flow path. The actuator overcap may further include a user-energized seal. The unique seal allows the actuator overcap to be adjusted to different positions, while reliably establishing a sealed passage between a valve stem and the selected barrel. According to certain embodiments, the actuator overcap may further include a spring rib for disengaging the valve stem from the actuator overcap socket to prevent unintended discharge of product after releasing the selector1, also referred to herein as "post-use drool."

As used herein, the term "spray jet" refers to the three-dimensional shape of the material between the exit orifice and the target surface, while the term "spray pattern" refers to the two-dimensional area of the target surface that is covered by material when the nozzle is held stationary.

Fluid dispensing devices may use a variety of different containers. The containers may hold one or a combination of various ingredients, and typically use a permanent or temporary pressure force to discharge the contents of the container. When the container is an aerosol can, for example, one or more chemicals or other active ingredients to be dispensed are usually mixed in a solvent and are typically further mixed with a propellant to pressurize the can. Known propellants include carbon dioxide, selected hydrocarbon gas, or mixtures of hydrocarbon gases such as a propane/butane mix. For convenience, materials to be dispensed may be referred to herein merely as "actives", regardless of their chemical nature or intended function. The active/propellant mixture may be stored under constant, but not necessarily continuous, pressure in an aerosol can. The sprayed active may exit in an emulsion state, single phase, multiple phase, and/or partial gas phase. Without limitation, actives can include insect control agents (such as propellant, insecticide, or growth regulator), fragrances, sanitizers, cleaners, waxes or other surface treatments, and/or deodorizers.

An exemplary embodiment of a fluid dispensing device 10 is illustrated at FIG. 1 in the environment of an aerosol container. It will be appreciated, however, that other types of containers and discharging means, such as selector1 pumps, may be used without departing from the scope of this disclosure.

The illustrated dispenser 10 includes a container 12, such as a conventional aerosol metal (e.g., aluminum or steel) can, that defines an internal chamber 15 capable of housing material to be dispensed under pressure. The container 12 includes a cylindrical wall 14 that is closed at its upper margin by a dome 16 (FIG. 2). The upper margin of the can wall 14 may be joined to the dome via a can chime (not shown).

The dispenser 10 includes a conventional aerosol valve 41 (see, e.g., U.S. Pat. No. 5,068,099 for another such valve). The aerosol valve 41 has a valve stem 34 that is hollow and extends axially upward from the valve cup 20. In the exemplary embodiments described herein, the valve 41 is activated by depressing the stem 34 downward, however other types of valves, such as a valve that actuates when the stem is deflected sideways, or valves used in non-aerosol applications, may be used. Upon such activation, pressurized material from the container is released through the valve stem.

An overcap 50 is coupled to the container 12 for actuating the valve 41 as well as selecting a desired spray pattern, as discussed in greater detail below. As shown in FIG. 2, the overcap 50 may include three components: a cap 52, a trigger 54, and a selector1 56. FIG. 3 provides a rear perspective view of an assembled overcap 50.

Figure 4:
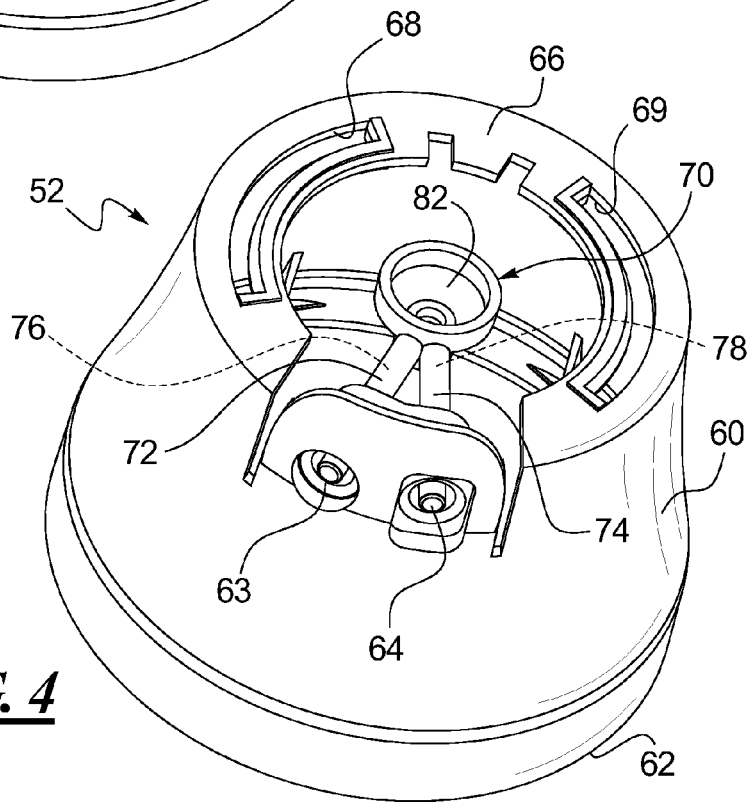
FIG. 4 is a perspective view of a cap used in the actuator overcap of FIG. 3.
Figure 5:
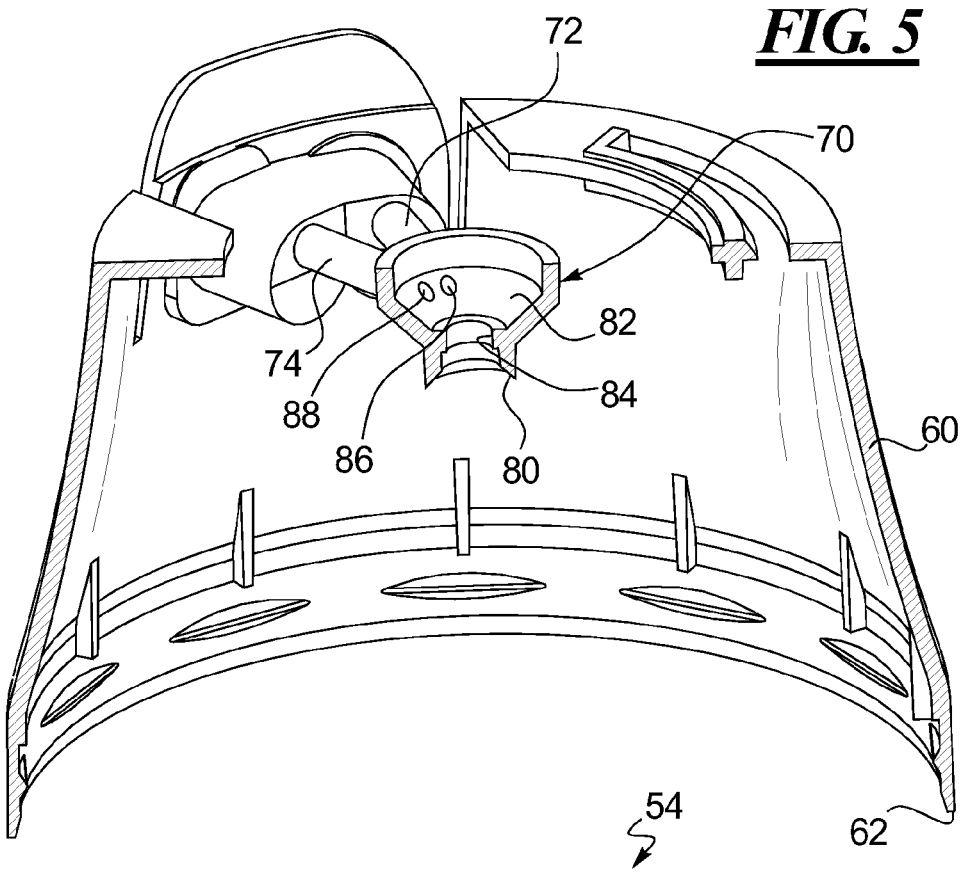
FIG. 5 is a perspective view, in cross-section, of the actuator overcap of FIG. 4.

The cap 52 is shown in greater detail in FIGS. 4 and 5. In the illustrated embodiment, the cap 52 includes a side wall 60 having a bottom edge 62 configured to engage a top end of the canister 12. First and second discharge orifices 63, 64 are formed in the side wall 60. The cap 52 may further include an annular top wall 66 having arcuate slots 68, 69 formed therein. A hub 70 may be centrally located on the cap 52 and may be connected to the side wall 60 by first and second barrels 72, 74. The barrels 72, 74 define flow paths 76, 78 that fluidly communicate with respective discharge orifices 63, 64. In the illustrated embodiment, the first barrel 72 is disposed at an acute angle with respect to the second barrel 74.

The hub 70 has a lower surface formed as a socket 80 configured to engage the valve stem 34. An upper surface of the hub 80 defines a chamber 82. A bottom of the chamber 82 fluidly communicates with the socket 80 through a central flow aperture 84. A first barrel aperture 86 may be formed in the hub upper surface to provide fluid communication between the chamber 82 and the first flow path 76. Similarly, a second barrel aperture 88 may be formed in the hub upper surface fluidly communicate between the chamber 82 and the second flow path 78. Nozzle inserts may be inserted into the first and second discharge orifices 63, 64 to obtain desired spray patterns. For example, FIG. 1 shows a wide spray pattern nozzle insert 65 disposed in the first discharge orifice 63. The second discharge orifice 64 may also have a nozzle insert (not shown).

The cap 52 is preferably formed of a resilient material to facilitate assembly and operation. During operation, for example, the hub 70 may be displaced downwardly to actuate the valve stem 34. Forming the cap 52 of a resilient material will allow the barrels 72, 74 to elastically deform, thereby permitting sufficient displacement of the hub 70 to operate the valve 41.

Figure 6:
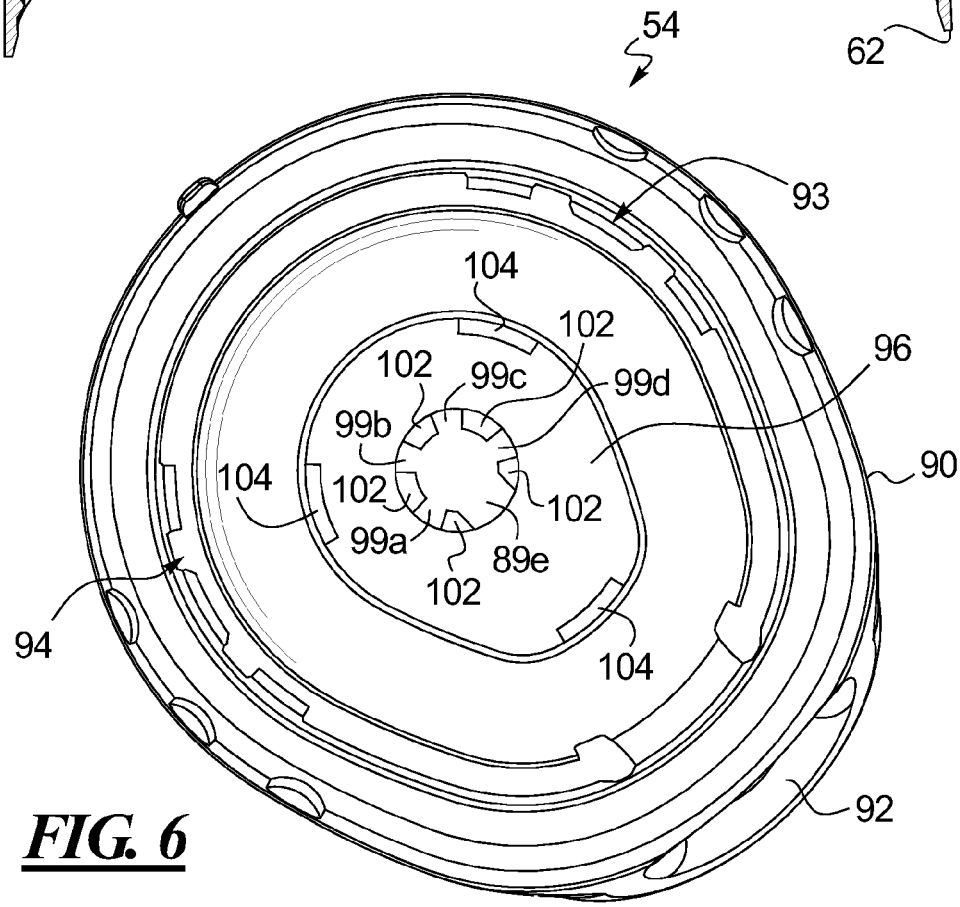
FIG. 6 is a top plan view of a trigger used in the actuator overcap of FIG. 3.
Figure 7:
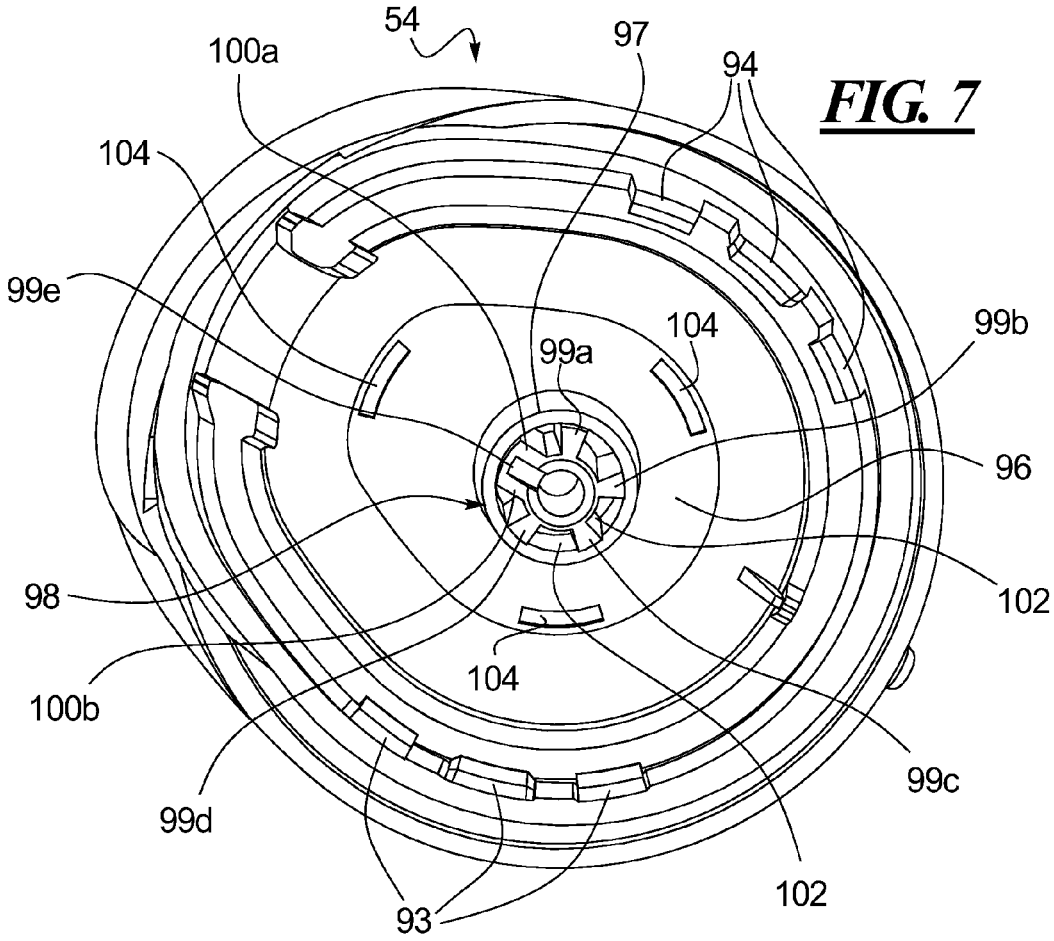
FIG. 7 is a bottom perspective view of the trigger of FIG. 6.

FIGS. 6 and 7 illustrate the trigger 54 in greater detail. The trigger 54 generally sits on top of and is pivotable with respect to the cap 52. The trigger 54 may include a side wall 90 having a spray opening 92 formed therein for providing access to a selected one of the first and second discharge orifices 63, 64 formed in the cap (best shown in FIGS. 1 and 2). The trigger 54 may also have a top wall 96.

Two sets of tabs 93, 94 may be provided to limit rotation of the trigger 54 with respect to the cap 52. As best shown in FIGS. 6 and 7, the sets of tabs 93, 94 may depend from the side wall 90 and may be configured to slidingly engage the cap slots 68, 69. The sets of tabs 93, 94 are sized and configured to provide a desired amount of rotation of the trigger 54 with respect to the cap 52. In the illustrated embodiment, the sets of tabs 93, 94 permit rotation of the trigger 54 between at least first and second positions. In the first position, the trigger spray opening 92 is aligned with the first discharge orifice 63. Similarly, when the trigger 54 is in the second position, the spray opening 92 is aligned with the second discharge orifice 64. The cap 52 may include indicia for indicating which position the trigger 54 is in. For example, as shown in FIG. 3, the cap 52 may have a first indicia 44 to indicate that the trigger 56 is in the first position and a second indicia 46 for the trigger second position. The indicia 44, 46 may provide information to the user regarding the type of spray pattern obtained in the associated trigger position. In the illustrated embodiment, the first indicia 44 is the word "SPRAY" to indicate that the dispenser 10 will produce a high-area or wide spray, while the second indicia 46 is the word "STREAM" to indicate that the dispenser 10 will produce a low-area or focused stream when actuated.

A boss 98 may extend through the top wall 96 to facilitate assembly with the selector1 56 and to provide support for a portion of the selector1 56, as discussed in greater detail below. The boss 98 may include an outer wall 97 and a plurality of webs 99*a-e*. Webs 99*a-d* may be solid and substantially identical in shape. Web 99*e*, however, may be formed with two spaced side walls 100*a*, 100*b*. The bottom surfaces of the outer wall 97 and webs 99*a-e* form a seal support. Gaps 102 provided between the webs 99*a-e* facilitate assembly of the trigger 54 with the selector1 56. The top wall 96 may further include engagement slots 104 for securing the selector1 56 to the trigger 54.

Figure 8:
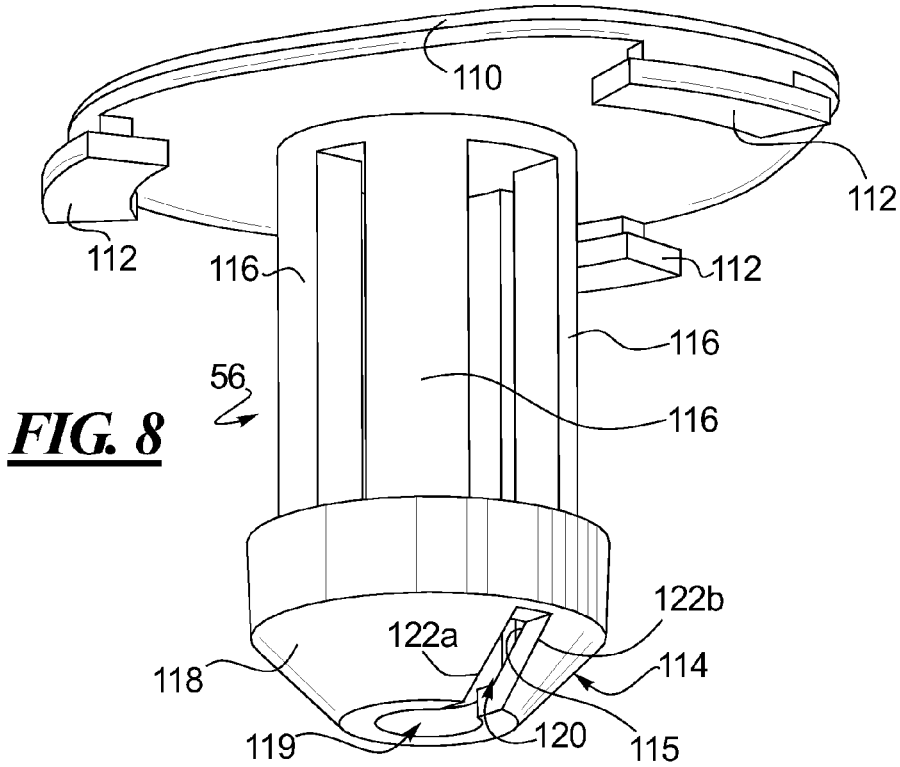
FIG. 8 is a perspective view of a selector1 used in the actuator overcap of FIG. 3.

The selector1 56 is coupled to and rotates with the trigger 54. As best illustrated in FIG. 8, the selector1 56 may include a user-engageable pad 110 disposed above the trigger top wall 96 (FIG. 3). Anchors 112 may depend from the pad 110 that are configured to fit through the engagement slots 104, thereby to secure and conform the pad 110 to the trigger 54.

The selector 56 may further include a seal 114 to ensure that active product flows through only the desired discharge orifice 63, 64. The seal 114 is coupled to the pad 110 by arms 116. In the illustrated embodiment, the seal 114 has a seal surface 118 configured to closely engage the hub upper surface defining the hub chamber 82. The seal 114 may also have a rear wall 115. A central aperture 119 is formed through a bottom of the seal 114 to provide fluid communication with the socket 80 when the seal 114 is disposed in the chamber 82. A notch 120 is formed in the seal surface 118 to provide fluid communication between the central aperture 119 and a desired barrel aperture 86, 88. The notch 120 may include diametrically opposed lateral side edges 122*a*, 122*b*.

When the overcap 50 is assembled, the trigger 54 may provide support to the selector seal 114. The outer wall 97 and webs 99*a-e* of the trigger boss 98 are configured to closely fit the rear wall 115 of the seal, thereby to provide support to the seal 114 as it rotates within the hub chamber 82 (FIG. 9). The spaced side walls 100*a*, 100*b* of web 99*e* are configured to engage the rear wall 115 adjacent the lateral side edges 122*a*, 122*b* of the notch 120, thereby to provide support. Accordingly, the seal 114 is better able to rotate within the chamber 82 without lost motion, thereby more reliably sealing the non-selected barrel aperture.

Materials for the trigger 54 and selector 56 may be chosen to facilitate assembly and operation. The trigger 54 may be formed of a relatively harder material to improve the seal support characteristics it provides. The trigger material may be somewhat resilient to permit downward movement of the trigger top wall 96 during actuation. The selector 56, however, may be formed of a softer, more resilient material. Such a selector material may improve the quality of the seal 114 when pressed into engagement with the hub 70 and may improve the comfort to the user when depressing the pad 110. It will be appreciated, therefore, that a user may energize the seal 114 by applying force to the pad 110. Without wishing to be limited, applicant has identified suitable selector materials to include thermoplastic elastomers (TPE), thermoplastic urethanes (TPU), thermoplastic rubbers (TPR), Buna-N, Neoprene, and silicone. The above-described selection of materials for the trigger 54 and the selector 56 may facilitate fabrication in a two-shot molding process, thereby reducing manufacturing costs and time.

The thickness of the seal 114 may be taken into account when selecting the seal material. Seal thickness directly affects the location of the trigger support surface (i.e., the outer wall 97 and webs 99*a-e* of the trigger boss 98), which in turn affects the amount of support provided to the seal 114. When the seal thickness is relatively small, the seal material may be softer since the support surface is positioned nearer (and therefore provides more support) to the sealing surface. Conversely, a larger seal thickness places the support surface farther away, and therefore a harder seal material may be needed to ensure that the seal rotates to the desired locations.

FIGS. 10-14 illustrate an alternative embodiment of a fluid dispensing device 200. The fluid dispensing device 200 is similar to the device 10 described above in that it is capable of producing multiple spray patterns. The device 200, however, has a different barrel layout and a modified seal.

Referring to FIG. 10, the fluid dispensing device 200 generally includes a canister 202 and an overcap 204. The canister 202 may be similar to the canister 12 of the previous embodiment, and therefore is not described in detail here. The overcap 204 may include three primary components: a cap 206, a trigger 208, and a selector 210.

Figure 11:
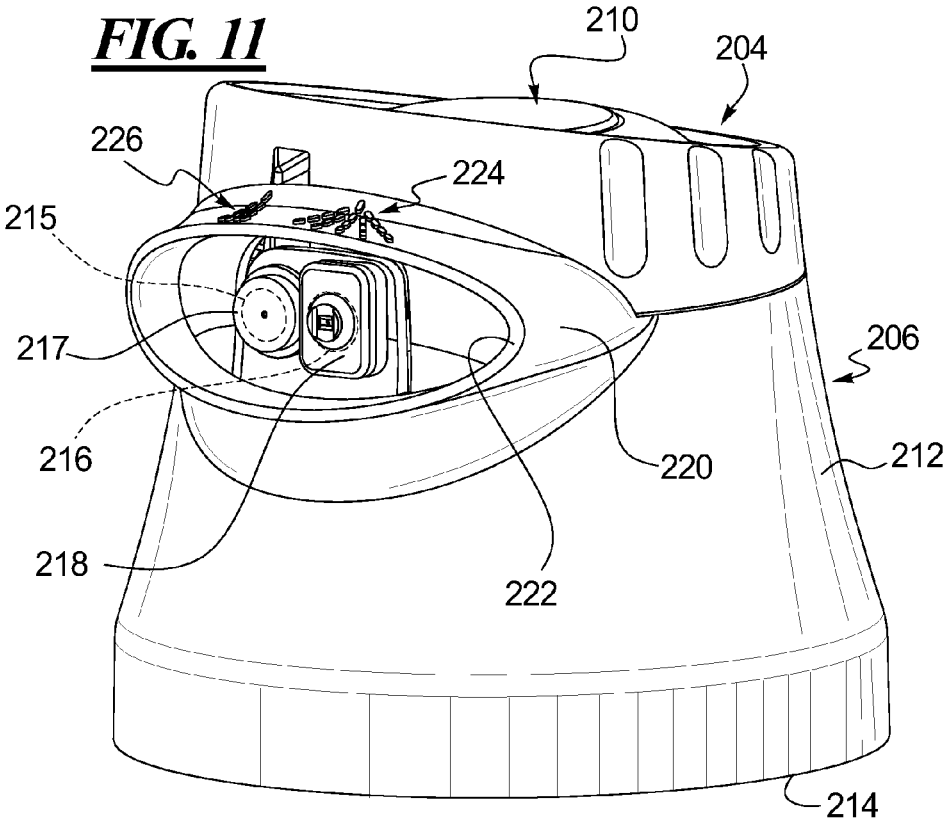
FIG. 11 is an enlarged perspective view of the actuator overcap provided with the fluid dispensing device of FIG. 10.
Figure 12:
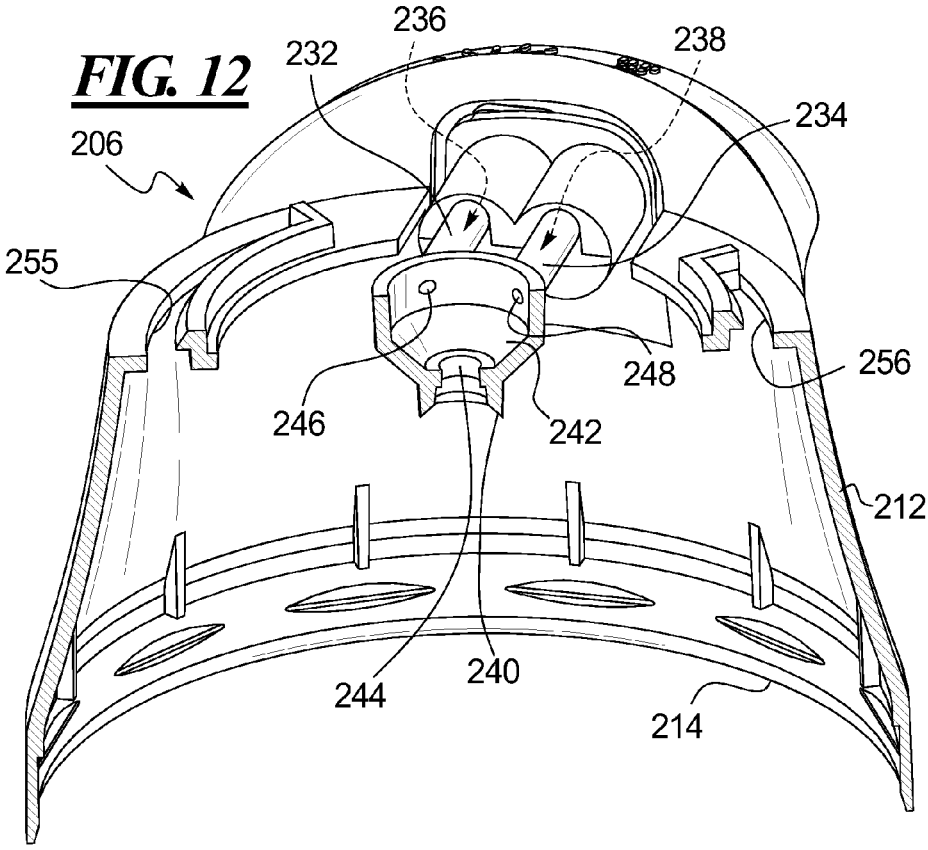
FIG. 12 is a perspective view, in cross-section, of a cap used in the actuator overcap of FIG. 11.

The cap 206 is shown in greater detail in FIGS. 11 and 12. The cap 206 may include a side wall 212 having a bottom edge 214 configured to engage the canister 202. First and second discharge orifices 215, 216 may be formed in the side wall 212, and nozzle inserts 217, 218 may be inserted into the discharge orifices. A discharge enclosure 220 may extend radially outwardly from the side wall 212 and define a discharge opening 222 through which the nozzle inserts 217, 218 may fluidly communicate with the environment. First and second indicia 224, 226 may be provided on the discharge enclosure 220 to indicate the type of spray pattern for a specific setting.

The cap 206 may include a hub 230 for interfacing with the canister valve. As best shown in FIG. 12, the hub 230 may be centrally located on the cap 206 and may be connected to the side wall 212 by first and second barrels 232, 234. The barrels 232, 234 define flow paths 236, 238 that fluidly communicate with respective discharge orifices 215, 216. In the illustrated embodiment, the first barrel 232 is disposed substantially parallel to the second barrel 234. The hub 230 has a lower surface formed as a socket 240 configured to engage the valve stem. An upper surface of the hub 240 defines a chamber 242. A bottom of the chamber 242 fluidly communicates with the socket 240 through a central flow aperture 244. A first barrel aperture 246 may be formed in the hub upper surface to provide fluid communication between the chamber 242 and the first flow path 236. Similarly, a second barrel aperture 248 may be formed in the hub upper surface fluidly communicate between the chamber 242 and the second flow path 238.

Figure 13:
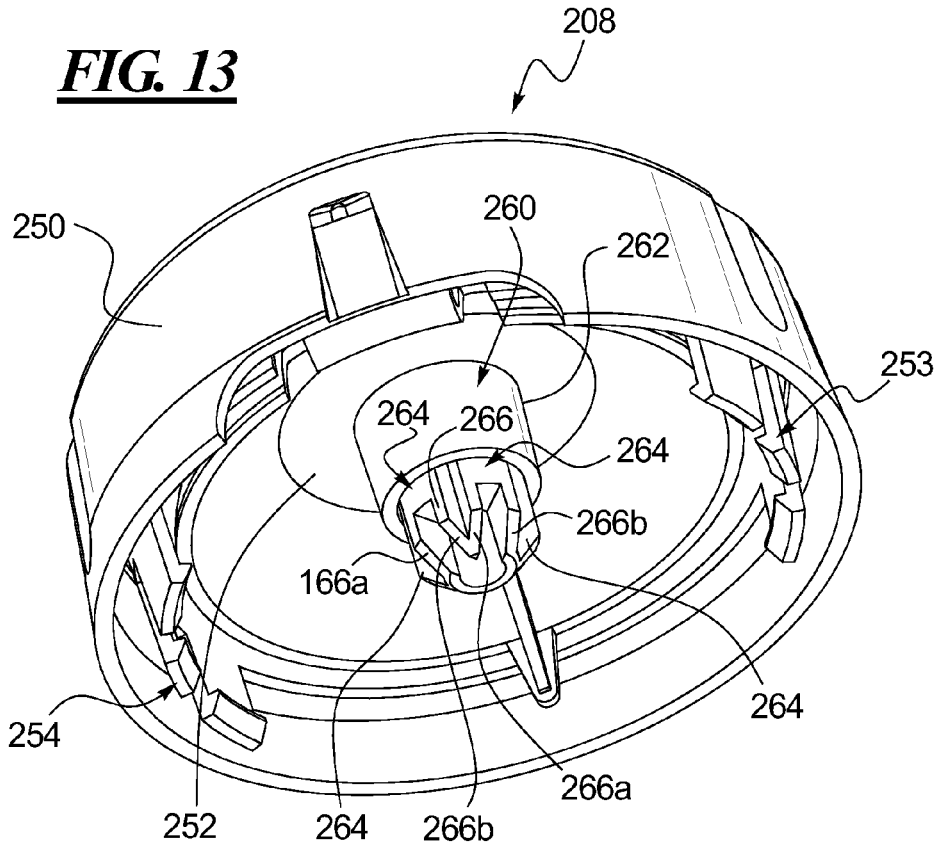
FIG. 13 is a bottom perspective view of a trigger used in the actuator overcap of FIG. 11.

The trigger 208 generally sits on top of and is pivotable with respect to the cap 206. As best shown in FIG. 13, the trigger 204 may include a side wall 250 and a top wall 252. The trigger 208 may further include structure for pivotably connecting it to the cap 206. For example, the trigger 208 may have two sets of tabs 253, 254 depending from the top wall 252 that slidingly engage slots 255, 256 formed in the cap 206.

A boss 260 may extend through the trigger top wall 252 to facilitate assembly with the selector 210 and to provide support for a portion of the selector 210. The boss 260 may include an outer wall 262 and a plurality of webs 264. Two of the webs 264 may be formed with two spaced side walls 266*a*, 266*b*. The bottom surfaces of the outer wall 262 and webs 264 form a seal support. Gaps provided between the webs 264 facilitate assembly of the trigger 208 with the selector 210. The top wall 252 may further include engagement slots 268 for securing the selector 210 to the trigger 208.

Figure 14:
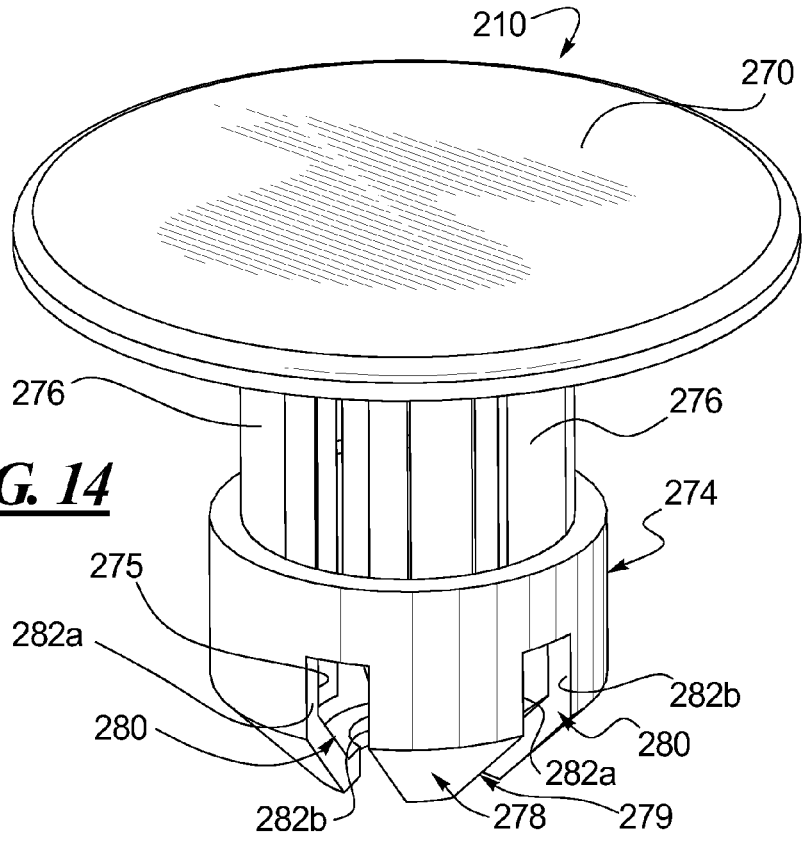
FIG. 14 is a perspective view of a selector1 used in the actuator overcap of FIG. 11.

The selector 210 is coupled to and rotates with the trigger 208. As best illustrated in FIG. 14, the selector 210 may include a user-engageable pad 270 disposed above the trigger top wall 252 (FIG. 11). The selector 210 may further include a seal 274 to ensure that active product flows through only the desired discharge orifice 215, 216. The seal 274 is coupled to the pad 270 by arms 276. In the illustrated embodiment, the seal 274 has a seal surface 278 configured to closely engage the hub upper surface defining the hub chamber 242. The seal 274 may also have a rear wall 275. A central aperture 279 is formed through a bottom of the seal 274 to provide fluid communication with the socket 240 when the seal 274 is disposed in the chamber 242. Two notches 280 are formed in the seal surface 278 to provide fluid communication between the central aperture 279 and a desired barrel aperture 246, 248. The notches 280 may include diametrically opposed lateral side edges 282*a*, 282*b*.

When the overcap 204 is assembled, the trigger 208 may provide support to the selector seal 274. The outer wall 262 and webs 264 of the trigger boss 260 are configured to closely fit the rear wall 275 of the seal, thereby to provide support to the seal as it rotates within the hub chamber 242. The spaced side walls 266*a*, 266*b* of selected webs 264 are configured to engage the rear wall 275 adjacent the lateral side edges 282*a*, 282*b* of the notch 280, thereby to provide support. Accordingly, the seal 274 is better able to rotate within the chamber 242 without lost motion, thereby more reliably sealing the non-selected barrel aperture.

By providing parallel barrels 232, 234 and two seal notches 280, a smaller degree of rotation is needed to adjust the overcap 204 between the two operating positions, thereby permitting a user to more quickly and easily select a desired spray pattern.

Figure 15:
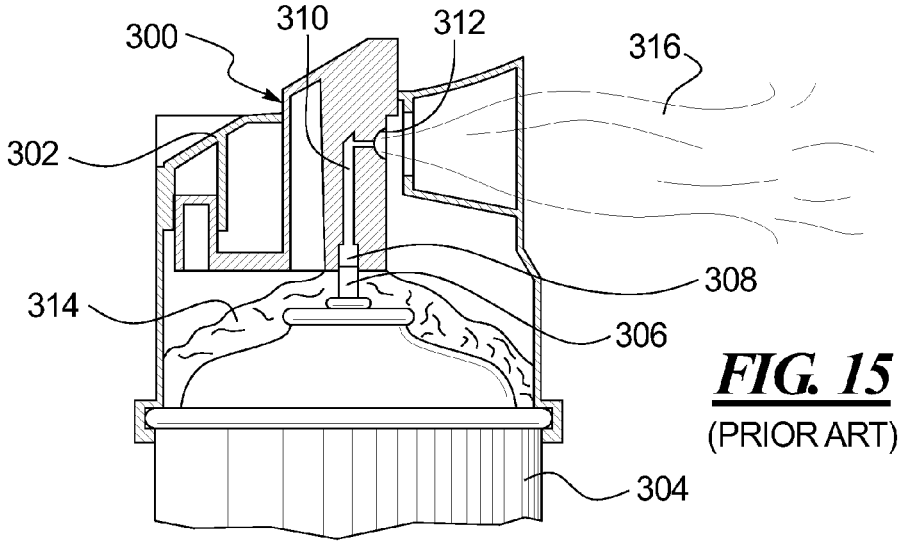
FIG. 15 (PRIOR ART)
FIG. 15 is a side elevation view, in cross-section, of a prior art fluid dispensing device.

The different seal embodiments disclosed above provide a significant improvement over prior art multi-spray devices. An exemplary prior art multi-spray device is shown in FIG. 15. The device includes a spray head 300 with an upper portion extending upwardly through an opening in an overcap 302. The overcap 302 encloses a top portion of a container 304, including a valve stem 306. The spray head 300 includes multiple inlet ports 308 sized to receive the valve stem 306. Each inlet port 308 fluidly communicates with a respective passage 310 having an associated nozzle outlet aperture 312. Significantly, the prior art device lacks a user-energized seal, and therefore product may leak into the space between the top of the container 304 and the bottom of the overcap 302. Leaked product is indicated in FIG. 15 by reference number 314. Additionally, with less product reaching the nozzle outlet aperture 312, the device does not achieve the desired spray pattern and volume, but instead it creates a reduced spray pattern 316 and delivers a reduced volume of product. The user-energized seal disclosed above, however, minimizes the amount of leakage at the connection between the overcap and the container valve, thereby more reliably generating the desired spray pattern.

Figure 16:
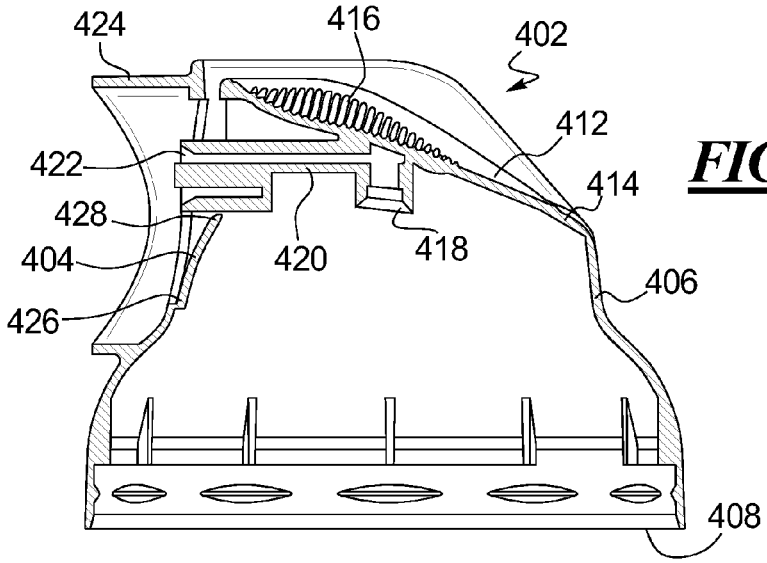
FIG. 16 is a side elevation view, in cross-section, of a further embodiment of an overcap having a spring rib, with the overcap in a normal position.
Figure 17:
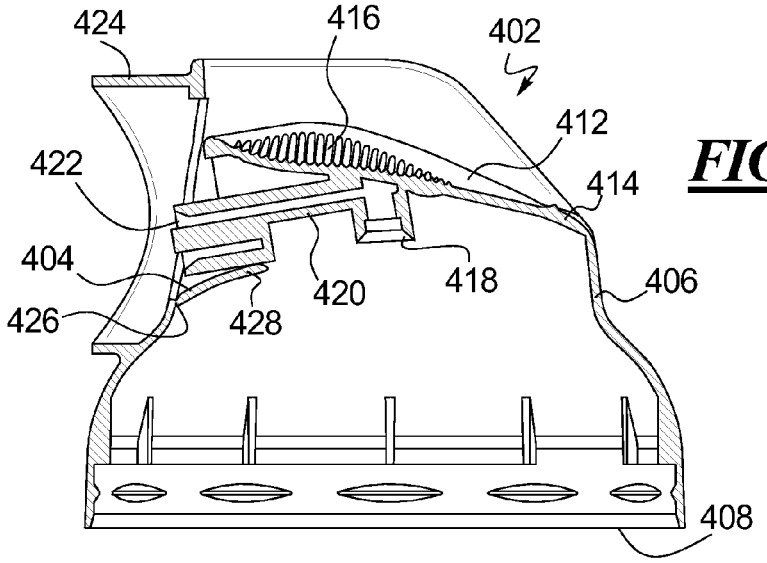
FIG. 17 is a side elevation view, in cross-section, of the overcap of FIG. 16 in an actuated position.

Yet another embodiment of an overcap 402 is illustrated in FIGS. 16 and 17. The overcap 402 has a spring rib 404 configured to minimize post-use drool, as discussed in greater detail below.

The overcap 402 includes a side wall 406 with a bottom edge 408 configured to engage a container of active product, such as the container 10 disclosed above. The overcap 402 may further include a top wall 412 flexibly coupled to the side wall 406, such as by a hinge 414. A top surface of the top wall 412 defines a pad 416 against which a user may apply an actuation force. A socket 418 depends from a bottom surface of the top wall and is sized to engage a valve stem (not shown). A barrel 420 fluidly communicates with the socket 418 and defines a nozzle outlet 422 through which product may be discharged. A shroud 424 extends radially from the side wall 406 and encircles the nozzle outlet 422. The top wall 412 is movable from a normal position (FIG. 16) to an actuated position in which the socket 418 engages and actuates the valve stem (FIG. 17).

The spring rib 404 may provide a return force for disengaging the socket 418 from the valve stem. In the illustrated embodiment, the spring rib 404 has a base end 426 resiliently coupled to the side wall 406 and a free end 428. The free end 428 may engage a lower surface of the barrel 420. The spring rib 404 is biased toward an initial, upright position which drives the barrel 420 upwardly. When the top wall 412 is depressed to the actuated position, the spring rib 404 deflects as shown in FIG. 17. When the top wall 412 is subsequently released, the spring rib 404 provides additional force to drive the barrel 420 upwardly, so that the socket 418 disengages from the valve stem. In so doing, the small amount of product still in the socket 418 and barrel 420 is allowed to flow back through the socket 418 to drain the area under the overcap 402 instead of dribbling out of the nozzle outlet 422, thereby minimizing post-use drool. To further assist with the reverse flow through the barrel 420, the barrel may be configured so that the end of the barrel near the nozzle outlet 422 is elevated slightly with respect to the opposite end near the socket 418 when the top wall 412 is in the normal position, as shown in FIG. 16.

While such embodiments have been set forth, alternatives and modifications will be apparent in the above description to those skilled in the art. These and other alternatives are considered equivalents in the spirit and scope of this disclosure and the appended claims.

INDUSTRIAL APPLICABILITY

The various embodiments of a fluid dispensing device disclosed herein may be capable of discharging an active in multiple spray patterns. The device may be used to dispense fragrances, cleaners, pest repellants, or other types of actives.

What is claimed is:

1. An actuator overcap for use with a canister having a stem valve, the actuator overcap comprising:

a cap having a bottom edge configured to engage the canister, the cap including a hub having a lower surface and an upper surface, the hub lower surface defining a socket configured to engage the stem valve, the hub upper surface defining a chamber fluidly communicating with the socket, a first barrel extending between the hub and a side wall of the cap and defining a first flow path and a first discharge orifice fluidly communicating with the first flow path, and a second barrel extending between the hub and the cap side wall and defining a second flow path and a second discharge orifice fluidly communicating with the second flow path;

a trigger pivotably coupled to the cap and having a side wall, a top wall, and a boss extending through the trigger top wall, the boss having a lower edge defining a seal support; and a selector coupled to the trigger, the selector including a user-engageable pad disposed above the trigger top wall and a seal disposed below the trigger top wall, the seal being configured to closely fit within the hub chamber, the seal further defining a central aperture fluidly communicating with the hub chamber and a first notch extending radially outwardly from and fluidly communicating with the central aperture;

wherein the trigger and selector are pivotable with respect to the cap to place the first notch in fluid communication with one of the first and second flow paths.

2. The actuator overcap of claim 1, in which the seal support engages at least a portion of the seal so that downward pressure applied to the selector pad deflects the trigger top wall, which in turn presses the seal into engagement with the hub upper surface, thereby to energize the seal.

3. The actuator overcap of claim 1, in which the first notch includes diametrically opposed lateral edges, and in which the seal support includes a first pair of support surfaces positioned to engage the seal adjacent the first notch lateral edges.

4. The actuator overcap of claim 1, in which the first barrel is disposed at an acute angle with respect to the second barrel.

5. The actuator overcap of claim 1, in which the selector further includes a second notch extending radially outwardly from and fluidly communicating with the central aperture, wherein the trigger and selector are pivotable with respect to the cap to place the second notch in fluid communication with one of the first and second flow paths.

6. The actuator overcap of claim 5, in which the second notch includes diametrically opposed lateral edges, and in which the seal support includes a second pair of support surfaces positioned to engage the seal adjacent the second notch lateral edges.

7. The actuator overcap of claim 5, in which the first barrel is disposed substantially parallel to the second barrel.

8. The actuator overcap of claim 1, in which the selector is formed of a material selected from a group of selector materials consisting of thermoplastic elastomer (TPE), thermoplastic urethane (TPU), thermoplastic rubbers (TPR), Buna-N, Neoprene, and silicone.

9. The actuator overcap of claim 1, further comprising a nozzle insert coupled to the first discharge orifice.

10. An actuator overcap for use with a canister having a stem valve, the actuator overcap comprising:

a cap having a bottom edge configured to engage the canister, the cap including a hub having a lower surface and an upper surface, the hub lower surface defining a socket configured to engage the stem valve, the hub upper surface defining a chamber fluidly communicating with the socket, a first barrel extending between the hub and a side wall of the cap and defining a first flow path and a first discharge orifice fluidly communicating with the first flow path, and a second barrel extending between the hub and the cap side wall and defining a second flow path and a second discharge orifice fluidly communicating with the second flow path, the first barrel being disposed at an acute angle with respect to the second barrel;

a trigger pivotably coupled to the cap and having a side wall, a top wall, and a boss extending through the trigger top wall, the boss having a lower edge defining a seal support; and a selector coupled to the trigger, the selector including a user-engageable pad disposed above the trigger top wall and a seal disposed below the trigger top wall, the seal being configured to closely fit within the hub chamber, the seal further defining a central aperture fluidly communicating with the hub chamber, and first and second notches extending radially outwardly from and fluidly communicating with the central aperture;

wherein the trigger and selector are pivotable with respect to the cap to place one of the first and second notches in fluid communication with a respective one of the first and second flow paths.

11. The actuator overcap of claim 10, in which the seal support engages at least a portion of the seal so that downward pressure applied to the selector pad deflects the trigger top wall, which in turn presses the seal into engagement with the hub upper surface, thereby to energize the seal.

12. The actuator overcap of claim 10, in which the first notch includes diametrically opposed lateral edges, and in which the seal support includes a first pair of support surfaces positioned to engage the seal adjacent the first notch lateral edges.

13. The actuator overcap of claim 12, in which the second notch includes diametrically opposed lateral edges, and in which the seal support includes a second pair of support surfaces positioned to engage the seal adjacent the second notch lateral edges.

14. The actuator overcap of claim 10, in which the selector is formed of a material selected from a group of selector materials consisting of thermoplastic elastomer (TPE), thermoplastic urethane (TPU), thermoplastic rubbers (TPR), Buna-N, Neoprene, and silicone.

15. The actuator overcap of claim 1, further comprising a nozzle insert coupled to the first discharge orifice.

16. An actuator overcap for use with a canister having a stem valve, the actuator overcap comprising:

a cap having a bottom edge configured to engage the canister, the cap including a hub having a lower surface and an upper surface, the hub lower surface defining a socket configured to engage the stem valve, the hub upper surface defining a hub chamber fluidly communicating with the socket, a first barrel extending between the hub and a side wall of the cap and defining a first flow path and a first discharge orifice fluidly communicating with the first flow path, and a second barrel extending between the hub and the cap side wall and defining a second flow path and a second discharge orifice fluidly communicating with the second flow path;

a trigger pivotably coupled to the cap and having a side wall, a top wall, and a boss extending through the trigger top wall, the boss having a lower edge defining a seal support; and a selector coupled to the trigger, the selector including a user-engageable pad disposed on top of the trigger top wall and a seal disposed in the hub, the seal being configured to closely fit within the hub chamber, the seal including an upper portion and a sloped seal surface portion disposed below the upper portion, the sloped seal surface portion defining a central aperture fluidly communicating with the hub chamber and defining a notch fluidly communicating with the central aperture, the notch confined to the sloped seal surface portion of the seal, wherein the trigger and selector are pivotable with respect to the cap to place the notch in fluid communication with one of the first and second flow paths.

* * * * *